United States Patent [19]

Chandley

[11] Patent Number: 4,977,948

[45] Date of Patent: Dec. 18, 1990

[54] COUNTERGRAVITY CASTING APPARATUS AND METHOD USING ELASTOMERIC SEALING GASKET AND COOLED VACUUM CHAMBER

[75] Inventor: George D. Chandley, Amherst, N.H.

[73] Assignee: General Motors Corporation, Detroit, Mich.

[21] Appl. No.: 411,187

[22] Filed: Sep. 20, 1989

Related U.S. Application Data

[63] Continuation-in-part of Ser. No. 219,460, Jul. 15, 1988, abandoned.

[51] Int. Cl.[5] ..... B22D 18/06

[52] U.S. Cl. ..... 164/255; 164/348

[58] Field of Search ..... 164/119, 254, 255, 256, 164/306, 63, 65, 348

[56] References Cited

U.S. PATENT DOCUMENTS 2,716,790 5/1951 Brennan .
4,340,108 7/1982 Chandley et al. ..... 164/63
4,606,396 8/1986 Chandley et al. ..... 164/255
4,616,691 10/1986 Voss ..... 164/255
4,632,171 12/1986 Almond ..... 164/255

*Primary Examiner*—Kuang Y. Lin
*Attorney, Agent, or Firm*—Reising, Ethington, Barnard, Perry & Milton

[57] ABSTRACT

A vacuum countergravity casting apparatus includes a vacuum chamber having a thermally conductive peripheral wall and a gas permeable mold sealed to the lower end of the peripheral wall by an elastomeric sealing gasket engaged therebetween. The peripheral wall is cooled at a location above and remote from the sealing gasket and an underlying molten metal pool when the mold is immersed in the pool during casting to maintain, by thermal conduction through the peripheral wall, the sealing gasket at a temperature to reduce thermal degradation thereof during casting; e.g., at a temperature below the gasket's thermal degradation temperature. Reduced thermal degradation of the sealing gasket during casting prolongs its useful life in casting successive molds.

3 Claims, 2 Drawing Sheets

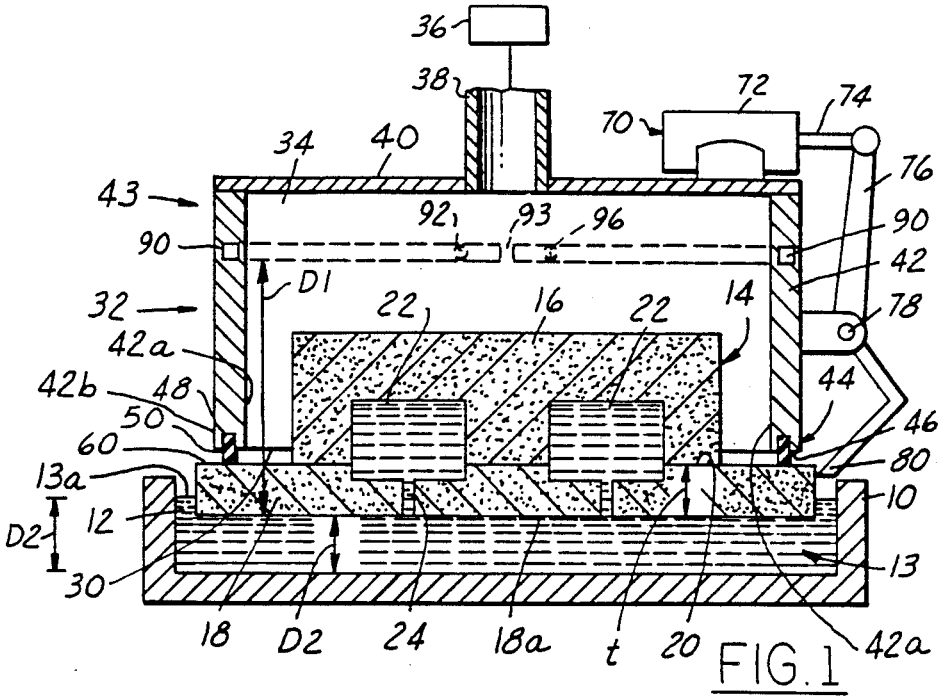
FIG. 1
FIG. 2
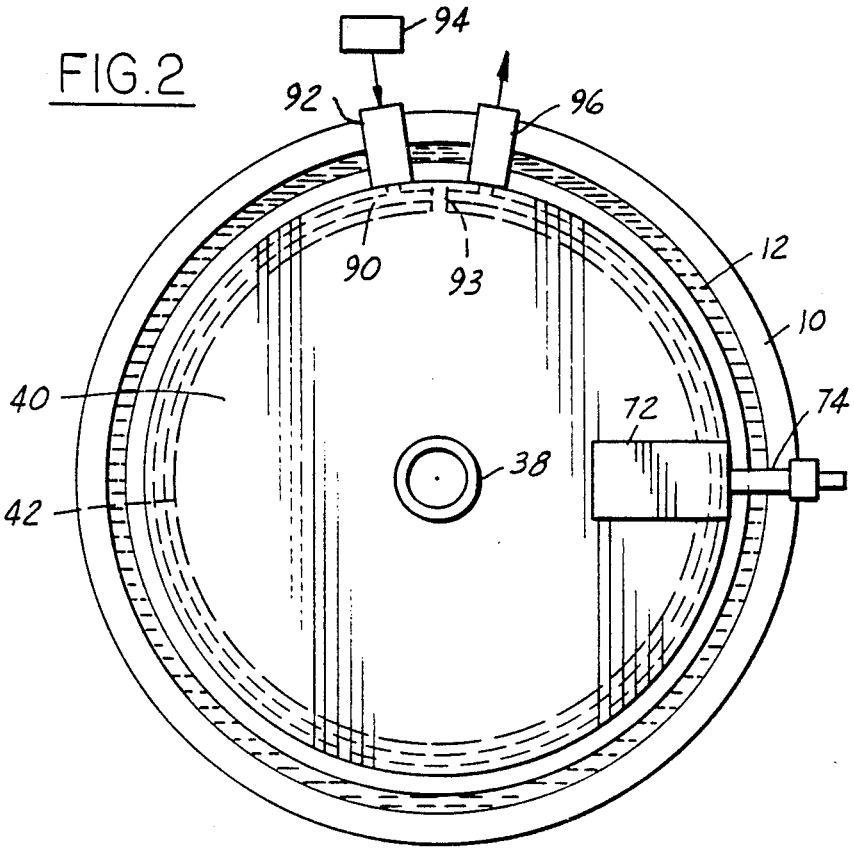

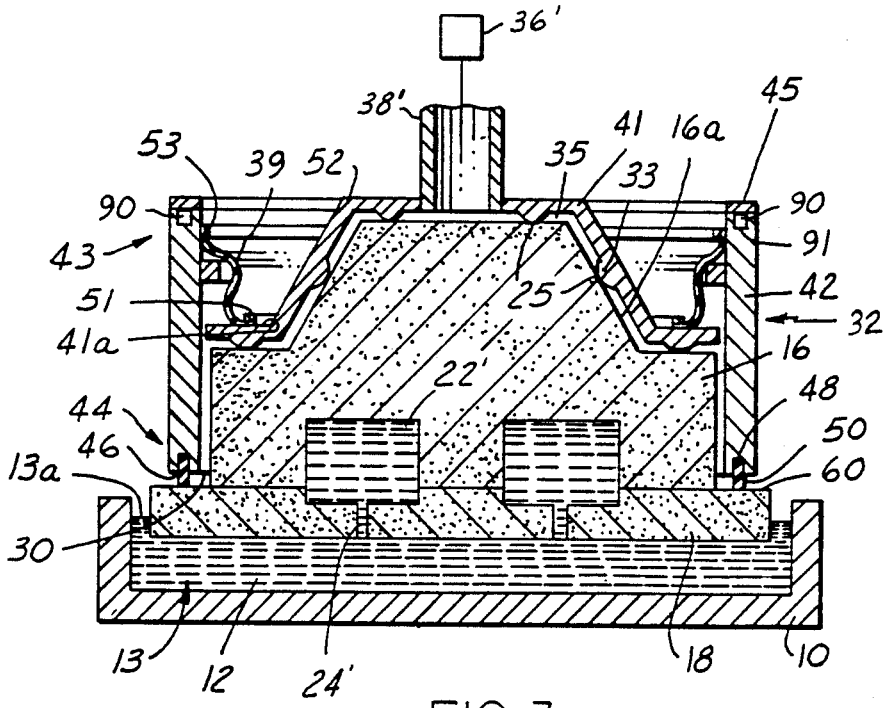
FIG. 3
FIG. 4
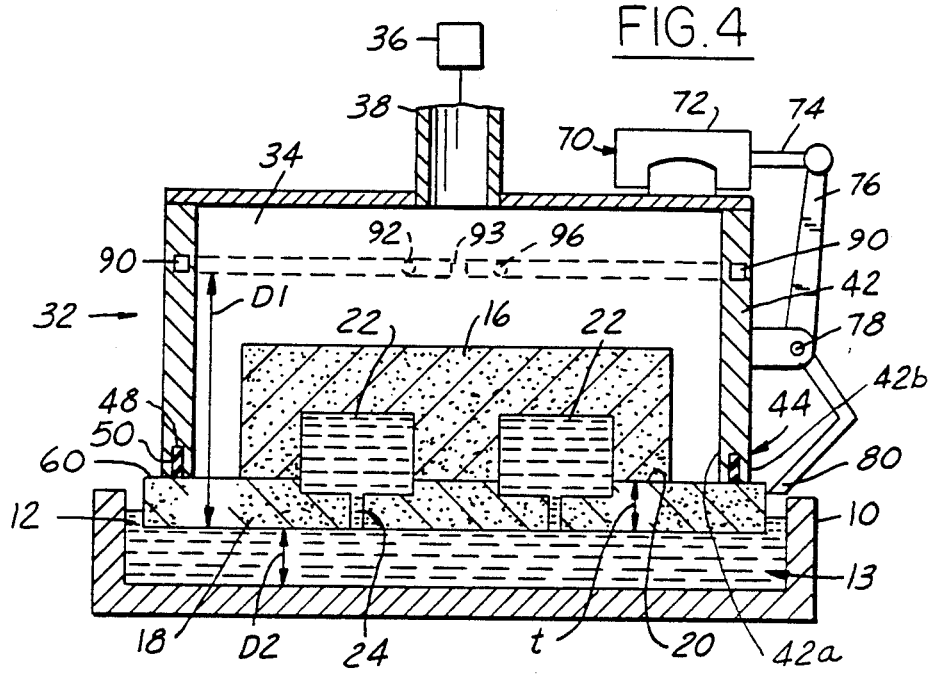

COUNTERGRAVITY CASTING APPARATUS AND METHOD USING ELASTOMERIC SEALING GASKET AND COOLED VACUUM CHAMBER

This is a continuation-in-part of co-pending application Ser. No. 219,460, filed on July 15, 1988, now abandoned.

FIELD OF THE INVENTION

The invention relates to the countergravity casting of molten metal in a gas permeable mold and, more particularly, to means for prolonging the useful life of an elastomeric sealing gasket that seals successive molds to a vacuum chamber.

BACKGROUND OF THE INVENTION

A vacuum countergravity casting process using a gas permeable mold is described in such prior patents as the Chandley et al U.S. Pat. Nos. 4,340,108 issued July 20, 1982, and 4,606,396 issued Aug. 19, 1986. That countergravity casting process involves providing a mold having a porous, gas permeable upper mold member (cope) and a lower mold member (drag) engaged together, sealing the bottom lip of a peripheral wall of a vacuum chamber to the mold such that the vacuum chamber confronts the gas permeable upper mold member, submerging the bottom side of the lower mold member in an underlying molten metal pool and evacuating the chamber to draw the molten metal through one or more ingate passages in the lower mold member and into one or more mold cavities formed between the upper and lower mold members.

The Voss U.S. Pat. No. 4,616,691 issued Oct. 14, 1986, discloses sealing the bottom lip of a peripheral wall of a vacuum chamber to a mold using a reusable elastomeric sealing gasket carried on the bottom lip. During casting when the mold is immersed in an underlying molten metal pool, the elastomeric sealing gasket is thermally insulated, conduction wise, from the heat of the underlying molten metal pool by the mold-forming material of the drag and shielded from the radiant heat of the molten metal pool by a skirt depending from the peripheral wall of the vacuum chamber. The sealing gasket is insulated, conduction wise, from the pool by a substantially thickened upstanding ridge or shoulder formed on the drag and is sealed to the mold at a site atop the mold which is thermally remote from the molten metal pool.

It is an object of the present invention to provide an improved vacuum countergravity casting apparatus and process wherein a vacuum chamber includes a cooled, thermally conductive peripheral wall having a lower end sealed to the mold by an elastomeric sealing gasket engaged therebetween and wherein cooling of the thermally conductive peripheral wall maintains the sealing gasket at a temperature where thermal degradation thereof is reduced during casting, thereby prolonging the useful life of the sealing gasket in the casting of successive molds.

SUMMARY OF THE INVENTION

The invention contemplates an improved vacuum countergravity casting apparatus comprising a mold having a porous, gas permeable upper mold portion at least in part defining a mold cavity therein and a lower mold portion having an ingate for admitting molten metal into the mold cavity from an underlying molten metal pool, a sealing surface on the mold, a housing defining a vacuum chamber confronting the upper mold portion and including a thermally conductive peripheral wall with an open lower end defining a mouth of the vacuum chamber, an elastomeric sealing gasket sealingly engaged between the lower end of the peripheral wall and the sealing surface on the mold to seal the mold to the mouth of the vacuum chamber, and means for cooling the peripheral wall to maintain, by thermal conduction through the peripheral wall, the sealing gasket at a temperature where thermal degradation of the sealing gasket is reduced when the lower mold portion is immersed in the molten metal pool during casting, preferably at a temperature below the thermal degradation temperature of the sealing gasket. The sealing gasket is thereby protected from thermal damage during casting and its useful life in casting successive molds is extended.

In one embodiment of the invention, the elastomeric sealing gasket is secured on the lower end of the thermally conductive peripheral wall and the means for cooling the peripheral wall is disposed adjacent an upper end of the peripheral wall above and remote from the sealing gasket and the molten metal pool when the lower mold portion is immersed in the molten metal pool for casting.

In another embodiment of the present invention, the means for cooling the peripheral wall comprises an internal cooling channel adjacent an upper end of the peripheral wall remote from the sealing gasket and the molten metal pool. The coolant channel is located sufficiently remote from the sealing gasket and the molten metal pool as to preclude boiling of liquid coolant in the channel and thus avoid possible significant reduction in heat transfer and possible vapor lock. A cooling fluid, such as water, is supplied to the cooling channel to cool and maintain the lower end of the peripheral wall and the sealing gasket below the thermal degradation temperature of the sealing gasket when the lower mold portion is immersed in the underlying molten metal pool during casting.

In still another embodiment of the invention, the means for cooling the peripheral wall of the vacuum housing is located a selected distance above the lower end of the peripheral wall to preclude submersion of the cooling channel in the molten metal pool when the lower mold portion is immersed therein during casting. In particular, the means for cooling the peripheral wall is disposed above the lower end of the peripheral wall a distance greater than the depth of the molten metal pool so that it is impossible to submerge the cooling means below the surface of the molten metal pool during casting.

The invention also contemplates a method for the countergravity casting of molten metal into a mold having a gas permeable upper mold portion defining at least in part a mold cavity and having a lower mold portion with an ingate for admitting the molten metal into the mold cavity, wherein the method includes the steps of (a) enclosing the upper mold portion within a vacuum chamber having a mouth defined by a lower end of a depending, thermally conductive peripheral wall, (b) sealing the mold to the mouth of the vacuum chamber by sealingly engaging an elastomeric sealing gasket between the lower end and the mold, (c) immersing the lower mold portion in an underlying molten metal pool, including sufficiently evacuating the vacuum chamber to urge molten metal into the mold cavity through the ingate and (d) cooling the peripheral wall while the mold is immersed in the molten metal pool to maintain, by thermal conduction through the peripheral wall, the sealing gasket at a temperature to reduce thermal degradation thereof during casting.

BRIEF DESCRIPTION OF THE DRAWINGS

The invention may be understood better when considered in light of the following detailed description of certain specific embodiments thereof which are given hereafter in conjunction with the following drawings.

FIG. 1 is a side sectional view through one embodiment of a vacuum countergravity metal casting apparatus in accordance with the present invention.

FIG. 2 is a plan view of the embodiment of FIG. 1.

FIG. 3 is a side sectional view through another embodiment of a vacuum countergravity metal casting apparatus in accordance with the invention.

FIG. 4 is a side sectional view through still another embodiment of a vacuum countergravity metal casting apparatus in accordance with the invention.

BEST MODE FOR PRACTICING THE INVENTION

FIGS. 1–2 illustrate a vacuum countergravity casting apparatus in accordance with one embodiment of the invention. The apparatus includes a container 10 of molten metal 12 to be drawn up into the mold 14. The mold 14 includes a porous, gas permeable upper mold portion 16 and a lower mold portion 18, which may be gas permeable or impermeable. The upper and lower mold portions 16, 18 may be adhesively secured together along juxtaposed surfaces that define a parting line or plane 20, although the upper and lower mold portions 16, 18 can be held together by other means; e.g., by ambient pressure as illustrated in FIG. 3.

Defined between the upper and lower mold portions 16, 18 are a plurality of mold cavities 22 (two shown) to be filled with molten metal from the molten metal pool 13 in the container 10 through respective ingate passages 24 on the underside or bottom 18*a* of lower mold portion 18 when the mold cavities are evacuated with the bottom 18*a* submerged in the molten metal pool 13. To this end, each ingate passage 24 extends from the bottom 18*a* of the lower mold portion to a respective mold cavity 22 that is formed at least in part in the upper mold portion 16. The number, size and spacing of the mold cavities 22 and the ingate passages 24 will vary with the type of part to be cast and the particular metal to be cast as explained in U.S. Pat. 4,340,108, the teachings of which are incorporated herein by reference.

Upper and lower mold portions 16, 18 can be made of resin-bonded sand in accordance with known mold practice wherein a mixture of sand or equivalent particles and bonding material is formed to shape and cured or hardened against a contoured pattern (not shown) having the desired complementary contour or profile for the parting surfaces and the mold cavities in the upper and lower mold portions. However, the invention is not so limited and may be used with other types of gas permeable molds including unitary investment molds of the high temperature ceramic type illustrated in the Chandley et al U.S. Pat. Nos. 3,863,706 and 3,900,064.

The mold 14 is sealingly received in the mouth 30 of a housing 32 that defines a vacuum chamber 34 confronting the gas permeable, upper mold portion 16, FIG. 1. The vacuum chamber 34 is communicated to a vacuum source 36 through a conduit 38 sealingly connected to the upper end wall 40 of the housing 32 so that the mold cavities 22 can be evacuated through the gas permeable upper mold portion 16 to draw the molten metal 12 through the bottom ingate passages 24 when the lower mold portion 18 is immersed in the molten metal pool 13.

The housing 32 includes the upper end wall 40 typically made of steel and an annular, peripheral wall 42 fastened to the upper end wall 40 by suitable means and made of a highly thermally conductive material, such as preferably copper. The peripheral wall 42 depends from the upper end wall 40 and terminates in a lower end 44. The lower end 44 includes an annular bottom lip 46 that defines the mouth 30 of the vacuum chamber 34. A continuous annular groove 48 is formed in the bottom lip 46 and extends upwardly therefrom. The groove 48 is shown having a rectangular cross-section but other cross-sectional shapes may be used.

An annular, elastomeric sealing gasket 50 (e.g., silicone rubber or fluoroelastomeric rubber) is received and secured (by glue or press fit) in the groove 48 in the bottom lip 46 so as to be carried with the housing 32 for repeated use in casting successive molds 14 and so as to be in thermally conductive relation to the bottom lip 46 of the peripheral wall 42. The sealing gasket 50 is shown having a rectangular cross-section to this end but other cross-sectional shapes can be employed. Moreover, the sealing gasket 50 may be secured to the inner side 42*a* or the outer side 42*b* of the lower end 44 of the peripheral wall 42 instead of to the bottom lip 46.

As shown in FIG. 1, the sealing gasket 50 extends from the groove 48 below the bottom lip 46 of the peripheral wall 42 to sealingly engage an annular, upwardly facing sealing surface 60 on the lower mold portion 18. The sealing gasket 50 is sealingly engaged and compressed between the bottom lip 46 of the thermally conductive peripheral wall 42 and the sealing surface 60 by securing the mold 14 and the housing 32 together using, for example, multiple conventional clamps 70 (only one shown) spaced around the periphery of the housing 32.

Each clamp 70 includes a fluid cylinder 72 mounted on the upper end wall 40 of the housing 32, a plunger 74 actuated by the cylinder 72 and a clamp arm 76 pivotable about pivot pin 78. Extension of the plunger 74 causes the clamp end 80 on the clamp arm 76 to grip the lower mold portion 18 to secure it against the housing 32 and to sealingly compress the sealing gasket 50. Other means may be used to hold the mold 14 and the metal housing 32 together with the sealing gasket 50 compressed between the bottom lip 46 of the peripheral wall 42 and the sealing surface 60 on the mold 14.

FIG. 4 illustrates a preferred embodiment of the invention (wherein like reference numerals represent like features or components of FIGS. 1–2) differing from the embodiment of FIGS. 1–2 in that the sealing gasket 50 is compressed substantially into the groove 48 and in that the bottom lip 46 of the peripheral wall 42 bottoms out (engages) against the sealing surface 60 on the lower mold portion 18 when the mold 14 and the metal housing 32 are held together. When compressed into the groove 48, the lowermost portion of the sealing gasket 50 sealingly engages the sealing surface 60. The groove 48 is suitably configured to accommodate compression of the sealing gasket 50 therein when the mold 14 and metal housing 32 are held together and to provide a large surface area of contact with the seal for enhanced heat transfer. In this embodiment of the invention, the cooled inner and outer sides 42*a* 42*b* of the peripheral wall 42 also protect the sealing gasket 50 from radiant heat from the molten metal 12 when the lower mold portion 18 is immersed therein as will be explained hereinbelow.

As is apparent in FIG. 1, during casting when the lower mold portion 1 is immersed in the molten metal pool 13, the sealing gasket 50 is brought in close proximity to the surface 13*a* of the molten metal pool 13 and is exposed to significant heat that radiates from the pool and that may be conducted through the lower mold portion 18. If during the casting of successive molds 14 the sealing gasket 50 repeatedly reaches temperatures above its thermal degradation temperature (e.g., about 600° F. for silicone rubber and about 450° F. for fluroelastomeric rubber), the sealing gasket 50 can be thermally degraded (thermal degradation typically being characterized by flattening, hardening and cracking of the sealing gasket and lose its effectiveness as a vacuum seal.

In accordance with the present invention, the useful life of the sealing gasket 50 in casting successive molds is extended by minimizing thermal degradation of the sealing gasket during casting. In particular, the thermally conductive peripheral wall 42 includes an internal, annular cooling channel 90 adjacent an upper end 43 of the peripheral wall in thermally conductive relation to the peripheral wall. The cooling channel 90 is spaced above and remote from the sealing gasket 50 and the molten metal pool 13 during casting a sufficient distance as to preclude boiling of the liquid coolant in the channel 90. An inlet fitting 92 is provided on the upper end 43 of the peripheral wall 42 on one side of an internal dividing wall 93 in the cooling channel 90 to supply a cooling liquid, such as water, to the cooling channel 90 from a coolant source 94. An outlet fitting 96 is also provided on the upper end 43 of the peripheral wall 42 on the opposite side of the dividing wall 93 to exhaust the cooling fluid from the cooling channel 90 after the cooling fluid absorbs heat from the peripheral wall 42 to cool same. The exhausted cooling fluid may be passed through a heat exchanger device (not shown) to cool the fluid for return to the coolant source 94 for recirculation to the cooling channel 90. Various cooling fluids may find use in the invention.

Typically, the cooling fluid is circulated through the cooling channel 90 as the mold 14 is advanced toward the molten metal pool 13, immersed therein for casting and then withdrawn away from the molten metal pool 13 after casting.

The cooling fluid flowing through the cooling channel 90 absorbs heat from the highly thermally conductive peripheral wall 42 to maintain the lower end 44 of the peripheral wall and the sealing gasket 50 received in the lower end 44 at a temperature below the thermal degradation temperature of the sealing gasket 50. Heat is conducted from the lower end 44 of the peripheral wall 42 and from the sealing gasket 50 to the cooled upper end 43 of the peripheral wall 42 and establishes a thermal gradient along the peripheral wall 42 to protect the thermally-degradeable sealing gasket 50 from thermal damage when the lower mold portion 18 is immersed in the molten metal 12 during casting. The particular cooling fluid used as well as its temperature and flow rate through the cooling channel 90 and the size, shape, number and location of the cooling channels 90 are selected to this end. Thermal degradation of the sealing gasket 50 is thereby significantly reduced and its useful life in casting successive molds 14 is increased.

The cooling channel 90 is spaced above the bottom lip 46 of the peripheral wall 42 and the lower mold portion 18 a distance D1 selected to preclude immersion of the cooling channel 90 in the molten metal 12 when the lower mold portion 18 is immersed therein for casting. In particular, the distance D1 is greater than the depth D2 of the molten metal pool 13 whereby it is impossible to immerse the cooling channel 90 below the surface of the molten metal pool 13 as a result of excessive movement of the mold 14 downwardly into the molten metal pool 13 during casting.

The cooling channel 90 may be provided in the upper end wall 40 of the housing 32 provided that the lower end 44 of the peripheral wall 42 and the sealing gasket 50 are sufficiently cooled by thermal conduction through the peripheral wall 42 to maintain the sealing gasket 50 at a reduced temperature to minimize thermal degradation thereof during casting. Furthermore, a separate cooling annulus (not shown) may be secured in thermally conducting relation on the housing 32; e.g. on the peripheral wall 42, to maintain the sealing gasket 50 at the desired reduced temperature by thermal conduction through the peripheral wall 42.

FIG. 3 illustrates still another embodiment of the invention wherein like reference numerals are used for like features or components of FIG. 1 and different reference numerals are used only when the Figures differ from one another. In particular, the vacuum housing 32 differs from that shown in FIG. 1 in that the housing 32 comprises a central, gas impermeable, upper end member 41 overlying and following the contour of the upper surface 16*a* of the upper mold portion 16. A plurality of standoffs 33 are spaced apart on the inner or lower side of the sheet metal member 41 and extend toward and into engagement with the upper surface 16*a* to provide a plurality of spaced apart contact regions 25 between the upper end member 41 and the upper surface 16*a*. The plurality of standoffs 33 establish a vacuum chamber 35 between the upper end member 41 and the upper surface 16*a*. A vacuum conduit 38 is sealingly attached to the upper end member 41. The vacuum chamber 35 is communicated through the conduit 38 to a vacuum source 36 to evacuate the mold cavities 22 through the porous, gas permeable upper mold portion 16.

The housing 32 further includes a flexible, annular sealing member 39 sealingly secured between the upper side 41*a* of the upper end member 41 and a highly thermally conductive (copper), annular, peripheral wall 42 of housing 32. Annular attachment rings 51, 53 are fastened to the upper end member 41 and the peripheral wall 42, respectively, to secure the flexible sealing member 39 thereto.

The thermally conductive peripheral wall 42 includes an internal cooling channel 90 formed in the upper end 43 thereof. In particular, an annular groove 91 is formed in the upper end of the peripheral wall 42 and is closed by an annular end cap 45 secured by suitable means to the peripheral wall 42 to form the cooling channel 90 therein. Inlet and outlet fittings (not shown) are secured on the peripheral wall 42 to supply cooling fluid to the cooling channel 90 and to exhaust cooling fluid therefrom in the same manner described hereinabove for FIGS. 1–2.

The peripheral wall 42 terminates in a lower end 44 that includes a bottom lip 46. The bottom lip 46 includes an upstanding, annular groove 48 in which an annular, elastomeric sealing gasket 50 is received and secured. The sealing gasket 50 extends below the bottom lip 46 to sealingly engage an annular, upwardly facing sealing surface 60 on the lower mold portion 18.

Cooling fluid, such as water, is circulated through the cooling channel 90 to maintain by thermal conduction through the peripheral wall 42, the sealing gasket 50 at a temperature below its thermal degradation temperature when the lower mold portion 18 is immersed in the underlying molten metal pool 13 during casting, as shown in FIG. 3, with the mold cavities 22 evacuated by the vacuum source 36 through the upper mold portion 16 to urge the molten metal 12 into the mold cavities 22. Ambient pressure above the upper end member 41 is transmitted to the upper mold portion 16 by the standoffs 33 in opposition to ambient pressure transmitted to the bottom 18*a* of the mold portion 18 through the molten metal 12. As a result, the upper mold portion 16 and lower mold portion 18 are held or engaged together by ambient pressure without the need for adhesive, as described in copending U.S. patent application Ser. No. 198,229 entitled "Countergravity Casting Apparatus And Method" filed in the name of George D. Chandley a inventor and assigned to the assignee of the present invention. A gas permeable member (not shown) may be used in lieu of the gas impermeable member 41 in FIG. 3 as taught in the aforesaid copending application Ser. No. 198,229.

In addition to extending the useful life of the sealing gasket 50 by reducing thermal degradation thereof during casting, the present invention is further advantageous from the standpoint that there is no need to increase the thickness t (FIG. 1) of the lower mold portion 18 to provide enhanced thermal insulation of the sealing gasket 50 from heat conduction through the mold-forming material of the lower mold portion 18 and further no need to completely shield the sealing gasket 50 from radiant heat of the molten metal pool 13 during casting. Cooling of the peripheral wall 42 as described hereinabove is effective to remove sufficient heat from the lower end 44 thereof to maintain the temperature of the sealing gasket 50 below its thermal degradation temperature during casting in spite of the conductive heat input through the lower mold portion 18 and the radiant heat input from the molten metal pool 13 during casting. However, the invention can be practiced in combination with these other thermal protection techniques (i.e., enhanced thermal insulation and/or radiant shielding as shown in FIG. 4).

While the invention has bee described in terms of specific embodiments thereof, it is not intended to be limited thereto but rather only to the extent set forth hereafter in the claims which follow.

I claim:

1. Apparatus for the countergravity casting of molten metal, comprising:

(a) a pool of molten metal, (b) a mold having a porous, gas permeable upper mold portion at least in part defining a mold cavity and having a lower mold portion with a bottom ingate for admitting molten metal into said mold cavity from the molten metal pool, (c) a sealing surface on said mold in thermal proximity to said pool, (d) a housing defining a vacuum chamber confronting the upper mold portion for evacuating said mold cavity through said upper mold portion, said housing having a highly thermally conductive peripheral wall consisting essentially of copper and a lip at the bottom of said wall defining a mouth of said chamber, (e) a thermally degradeable elastomeric sealing gasket secured in thermally conductive relation to said lip for sealingly engaging said sealing surface to seal said mold to the mouth of said chamber, and (f) means for conductively cooling said peripheral wall and said gasket, said means comprising (1) a coolant channel in thermally conductive relation to said peripheral wall, said channel being sufficiently remote from the sealing gasket as to preclude boiling of coolant therein and (2) means for supplying liquid coolant to said channel sufficient to so cool said wall and conductively extract sufficient heat from said gasket via said wall as to substantially maintain the temperature of said gasket below its thermal degradation temperature when the lower mold portion is immersed in the molten metal pool.

2. The apparatus of claim 1 wherein the height of the coolant channel above the sealing gasket is greater than the depth of the molten metal pool.

3. The apparatus of claim 1 wherein the bottom lip includes an upstanding groove defined between inner and outer sides of said peripheral wall and said sealing gasket is so received in said groove that said sides shield the sealing gasket from radiant heat from the molten metal and provide a relatively large surface area of contact with the sealing gasket for improved heat transfer therefrom to said wall.

* * * * *

UNITED STATES PATENT AND TRADEMARK OFFICE

CERTIFICATE OF CORRECTION

PATENT NO. : 4,977,948

DATED : December 18, 1990

INVENTOR(S) : George D. Chandley

It is certified that error appears in the above-indentified patent and that said Letters Patent is hereby corrected as shown below:

Column 5, line 7, delete "1" and insert --18-- therefor.

Column 5, line 19, after "gasket" insert --)--.

Signed and Sealed this

Seventeenth Day of August, 1993

Bruce Lehman

*Attest:*

BRUCE LEHMAN

*Attesting Officer*

*Commissioner of Patents and Trademarks*